US005923211A

United States Patent [19]

Maley et al.

[11] Patent Number: 5,923,211

[45] Date of Patent: Jul. 13, 1999

[54] REFERENCE VOLTAGE GENERATION SCHEME FOR GATE OXIDE PROTECTED CIRCUITS

[75] Inventors: Reading Maley, Stanford; Albrecht Schoy, San Jose, both of Calif.

[73] Assignee: Advanced Micro Devices, Inc., Sunnyvale, Calif.

[21] Appl. No.: 08/861,039

[22] Filed: May 21, 1997

[51] Int. Cl.[6] ..... G05F 3/02

[52] U.S. Cl. ..... 327/540; 327/538; 323/313; 323/314

[58] Field of Search ..... 327/538, 539, 327/540, 541, 543; 323/313, 314

[56] References Cited

U.S. PATENT DOCUMENTS 5,359,552 10/1994 Dhong et al. ..... 327/539
5,384,739 1/1995 Keeth ..... 323/314
5,506,541 4/1996 Herndon ..... 327/541
5,545,979 8/1996 Nukui et al. ..... 323/343
5,712,590 1/1998 Dries et al. ..... 327/539

*Primary Examiner*—Terry D. Cunningham
*Attorney, Agent, or Firm*—Davis Chin

[57] ABSTRACT

A reference voltage generation circuit is provided for use in gate oxide protected circuits for generating an NMOS reference voltage and PMOS reference voltage in which the NMOS reference voltage is independent of an I/O buffer power supply potential and in which the PMOS reference voltage tracks the supply voltage. The reference voltage generation circuit includes a bandgap voltage reference circuit, a first operational amplifier, a voltage divider and a second operational amplifier. In one embodiment, the NMOS reference voltage is approximately +2.2 volts and is referenced with respect to ground. The PMOS reference voltage is approximately +1.1 volts and referenced with respect to the I/O buffer power supply voltage and the NMOS reference voltage.

9 Claims, 1 Drawing Sheet

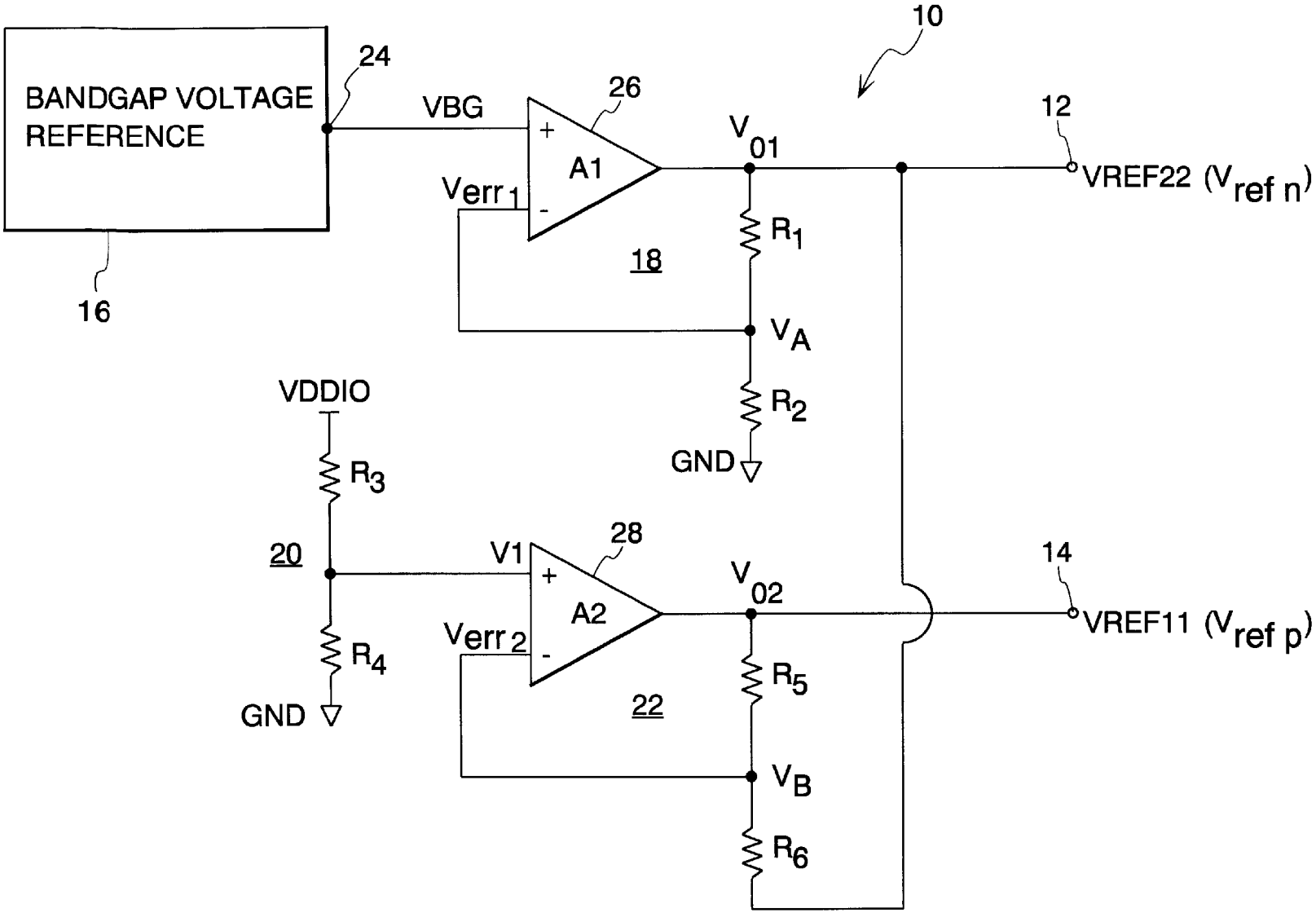
10
12
VREF22 ($V_{ref\ n}$)
14
VREF11 ($V_{ref\ p}$)
$V_{01}$
$R_1$
$V_A$
$R_2$
GND
18
26
A1
+
-
$Verr_1$
VBG
24
BANDGAP VOLTAGE REFERENCE
16
$V_{02}$
$R_5$
$V_B$
$R_6$
22
28
A2
V1
$Verr_2$
VDDIO
$R_3$
20
$R_4$
GND

REFERENCE VOLTAGE GENERATION SCHEME FOR GATE OXIDE PROTECTED CIRCUITS

BACKGROUND OF THE INVENTION

This invention relates generally to voltage reference generation circuits, and more particularly, it relates to a new and improved reference voltage generation circuit used in gate oxide protected circuits for generating an NMOS reference voltage and a PMOS reference voltage, which are independent of an I/O buffer power supply voltage.

As is generally well-known in the art of modern digital integrated circuits, especially those manufactured in accordance with complementary metal-oxide-semiconductor (CMOS) technology, the reliability and performance of the circuit operation is frequently determined by the availability of a stable reference voltage. There are many types of functional circuits internal to an integrated circuit which require stable reference voltages in order to operate properly and effectively. Such functional circuits may include operational amplifiers, inverter circuits, level shifting circuits, output driver circuits, memory circuits, microprocessors, logic gate circuits, input/output driver circuits, and I/O buffer circuits.

These various functional circuits on the first integrated circuit will typically be used to generate output signals which communicate with another second integrated circuit, that is powered by a power supply voltage having a predetermined voltage level higher than a supply potential applied to the first integrated circuit. For example, the supply potential applied to the functional circuits may normally be only +2.0 volts with respect to a ground potential. On the other hand, the second integrated circuit receiving the output signals from the functional circuits may have a power supply voltage of +3.3 volts. In order to accommodate for this communication with the second integrated circuit, the supply potential applied to the functional circuits must be increased to or near +3.3 volts.

However, in view of the development made in CMOS technologies, the thickness of the transistor gate oxide for forming the CMOS devices are becoming thinner and thinner. In the typical semiconductor process, when the thickness of the gate oxide is reduced to approximately 60 Å (angstroms) or below, a voltage difference higher than about +2.4 volts–+2.5 volts applied across the gate oxide of the transistor device will cause a breakdown of the gate oxide to occur, thereby resulting in a failure of the functional circuits. In order to overcome this problem, there have been provided in the prior art, gate oxide protection circuits utilizing plurality of PMOS and NMOS transistors so as to limit the voltage difference at the gate oxide to be below a breakdown voltage magnitude.

In co-pending application Ser. No. 08/599,898 filed on Feb. 12, 1996, and entitled "Gate Oxide Voltage Limiting Devices for Digital Circuits," which is assigned to the same assignee as the present invention, there is illustrated in FIG. 4 a gate oxide protected inverting level shifter 4', which includes PMOS transistors $L_{P1}$, $L_{P2}$, and $L_{P5}$ and NMOS transistor $L_{N2}$. The gates of the PMOS transistors are connected to a PMOS reference voltage $V_{refp}$, and the gate of the NMOS transistor is connected to an NMOS reference voltage $V_{refn}$. In FIG. 5, there is depicted a gate oxide protected inverter 2', which includes PMOS transistors $I_{P1}$ and $I_{P3}$ whose gates are connected to reference voltage $V_{refp}$ and NMOS transistor $I_{N1}$ and $I_{N2}$ whose gates are connected to reference voltage $V_{refn}$. Further, there is shown in FIG. 8 an I/O buffer which includes a gate protected output driver circuit 6' formed of a PMOS transistor $D_{P2}$ and an NMOS transistor $D_{N2}$. The gate of the transistor $D_{P2}$ is connected to reference voltage $V_{refp}$, and the gate of transistor $D_{N2}$ is connected to reference voltage $V_{refn}$.

Each of the inverting level shifter, inverter, and output driver circuit is powered by an upper predetermined I/O supply voltage $V_{CCIO}$ and a lower predetermined power supply voltage $V_{SSIO}$, where $V_{CCIO}$=+3.3 V and $V_{SSIO}$=0 V. Assuming that the gate oxide thickness is about 60 angstroms, and the gate oxide breakdown voltage is about +2.4V–+2.5 V, then the reference voltage $V_{refp}$ may be equal to about +1.1 V and the reference voltage $V_{refn}$ may be about +2.2 V.

The inventors of the present invention have developed a reference voltage generation scheme for generating the reference voltages $V_{refn}$ and $V_{refp}$ for gate oxide protected circuits. The reference voltage $V_{refn}$ is independent of the upper predetermined I/O supply voltage $V_{CCIO}$. The reference voltage $V_{refp}$ is always a constant voltage below the supply voltage $V_{CCIO}$, independent of the voltage between $V_{CCIO}$ and $V_{SSIO}$. In this way the gate-to-source voltage, which is the principal control mechanism for a MOS device, remains constant for both PMOS and NMOS devices, no matter what the value of $V_{CCIO}$ is. The instant reference voltage generation circuit is comprised of a bandgap reference voltage, a first operational amplifier, a voltage divider, and a second operational amplifier.

SUMMARY OF THE INVENTION

Accordingly, it is a general object of the present invention to provide a new and improved reference voltage generation circuit which is relatively simple and economical to manufacture and assemble.

It is an object of the present invention to provide an improved reference voltage generation circuit used in gate oxide protected circuits for generating an NMOS reference voltage and a PMOS reference voltage in which the NMOS reference voltage is independent of an I/O buffer power supply voltage and in which the PMOS reference voltage tracks the supply voltage.

It is another object of the present invention to provide an improved reference voltage generation circuit used in gate oxide protected circuits which includes a bandgap reference voltage, a first operational amplifier, a voltage divider, and a second operational amplifier, all operatively connected together.

It is still another object of the present invention to provide an improved reference voltage generation circuit used in gate oxide protected circuits for generating an NMOS reference voltage of about +2.2 volts and a PMOS reference voltage of about +1.1 volts.

In a preferred embodiment of the present invention, there is provided a reference voltage generation circuit used in gate oxide protected circuits for generating an NMOS reference voltage and a PMOS reference voltage. The reference voltage generation circuit includes a bandgap voltage reference circuit, a first operational amplifier, a voltage divider, and a second operational amplifier. The bandgap reference voltage circuit is used to generate a stable reference voltage. The first operational amplifier has a non-inverting input, an inverting input, and an output. The first operational amplifier has its non-inverting input responsive to the stable reference voltage for generating the NMOS reference voltage at its output. The voltage divider is used to generate an input voltage proportional to an I/O buffer power supply voltage.

The second operational amplifier also includes a non-inverting input, an inverting input, and an output. The second operational amplifier has its non-inverting input responsive to the input voltage and its inverting input responsive to the NMOS reference voltage at the output of the first operational amplifier for generating the PMOS reference at its output.

BRIEF DESCRIPTION OF THE DRAWINGS

These and other objects and advantages of the present invention will become more fully apparent from the following detailed description when read in conjunction with the accompanying drawing in which there is shown a schematic circuit diagram of the improved reference voltage generation circuit of the present invention.

DESCRIPTION OF THE PREFERRED EMBODIMENT

Referring now in detail to the single drawing of the particular illustration, there is shown a schematic circuit diagram of a reference voltage generation circuit 10, constructed in accordance with the principles of the present invention. The reference voltage generation circuit 10 generates an NMOS reference voltage VREF22 ($V_{refn}$)on its output terminal 12 and a PMOS reference voltage VREF11 ($V_{refp}$) on its output terminal 14. The NMOS reference voltage is independent of an upper I/O buffer power supply voltage or potential VDDIO. The reference voltage $V_{refp}$ is always a constant voltage below the supply voltage $V_{CCIO}$, independent of the voltage between $V_{CCIO}$ and $V_{SSIO}$. In this way the gate-to-source voltage, which is the principal control mechanism for a MOS device, remains constant for both PMOS and NMOS devices, no matter what the value of $V_{CCIO}$ is. These reference voltages, VREF22 and VREF11, are utilized by gate oxide protection circuits which are formed of a plurality of PMOS and NMOS transistors. Such gate oxide protection circuits are illustrated and described in the aforementioned Ser. No. 08/599,898. Specifically, the NMOS reference voltage VREF22 ($V_{refn}$) is applied to the gates of NMOS transistors and the PMOS reference voltage VREF11 ($V_{refp}$) is applied to the gates of the PMOS transistors so as to limit the voltage difference at the gate oxide to be less than a breakdown voltage magnitude.

The reference voltage generation circuit 10 is comprised of a bandgap voltage reference circuit 16, a first operational amplifier network 18, a voltage divider 20, and a second operational amplifier network 22. The bandgap voltage reference circuit 16 is a well-known conventional circuit which produces a constant voltage VBG on its output node 24. The voltage VBG has the characteristics that it is stable and that it tracks variations in processing and changes in operating parameters, such as temperature changes over the range of −55° C. to +125° C. and variations in the power supply voltage. Typically, the constant voltage VBG at the output node 24 is set to be approximately +1.25 volts which is fed into the first operational amplifier network 18.

The first operational amplifier network 18 includes an operational amplifier 26, a first resistor R1, and a second R2. The non-inverting input of operational amplifier 26 is connected to receive the bandgap voltage VBG. One end of the first resistor R1 is connected to the output of the operational amplifier and to the output terminal 12. The output of the operational amplifier 26 generates the NMOS reference voltage VREF22 at the output terminal 12. The other end of the first resistor R1 is connected to one end of the second resistor R2 and to the inverting input of the operational amplifier. The other end of the resistor R2 is connected to a lower predetermined or referenced power supply potential GND (ground) or 0 volts.

The voltage divider 20 is formed of a third resistor R3 and a fourth resistor R4. One end of the third resistor R3 is connected to an upper predetermined I/O buffer power supply voltage VDDIO. The I/O buffer power supply voltage VDDIO is typically set to an upper voltage level of approximately +3.3 volts as to facilitate communication or interface of the gate protected circuits with external circuits in spite of the fact that the gate oxide cannot generally tolerate such a high voltage. The other end of the third resistor R3 is connected to one end the fourth resistor R4 and to the input of the second operational amplifier network 22. The other end of the fourth resistor R4 is also connected to the lower predetermined power supply GND.

The second operational amplifier network 22 includes an operational amplifier 28, a fifth resistor R5 and a sixth resistor R6. The non-inverting input of the operational amplifier 28 is connected to receive an input voltage V1 from the voltage divider 20, which is proportional to the I/O buffer power supply voltage potential VDDIO. One end of the fifth resistor R5 is connected to the output of the operational amplifier and to the output terminal 14. The output of the operational amplifier 28 generates the PMOS reference voltage VREF11 at the output terminal 14. The other end of the fifth resistor R5 is connected to one of the sixth resistor R6 and to the inverting input of the operational amplifier 28. The other end of the sixth resistor R6 is connected to the output of the first operational amplifier 26 and to the output terminal 12 for receiving the NMOS reference voltage VREF22.

Since the operational amplifier 26 is connected in a non-inverting configuration, its output voltage $V_{01}$ on the output terminal 12 can be expressed mathematically as follows:

$$V_{01} = A1(V_{err1}) \tag{1}$$

where A1 is gain of amplifier 26

Further, the voltage $V_A$ applied to the inverting input is given by:

$$V_A = \frac{R_2}{R_1 + R_2}(V_{01}) \tag{2}$$

From Kirchoff's Voltage Law, it can be determined that:

$$VBG = V_{err1} + V_A \tag{3}$$

If the gain A1 of the operational amplifier 26 is assumed to be very high (typically in excess of 100,000), then it can be seen from the equation (1) that $V_{err1}$ will be very small. Thus, the equation (3) can be simplified to:

$$VBG \approx V_A = \frac{R_2}{R_1 + R_2}(V_{01}) \tag{4}$$

By substituting VREF22 for $V_{01}$ into equation (4) and solving the same for VREF22, we have:

$$VREF22 = \left(1 + \frac{R_1}{R_2}\right)VBG \tag{5}$$

If the bandgap voltage VBG is set to +1.2 volts, and the ratio of the resistance R1/R2 is made equal to ¾, then the NMOS reference voltage VREF22 ($V_{refn}$) will be given as follows:

$$\begin{aligned} VREF22 &= \left(1 + \frac{3}{4}\right)1.25\text{ V} \\ &= (1.75)(1.25\text{ V}) = 2.19\text{ V} \\ &\approx 2.2\text{ V} \end{aligned} \tag{6}$$

It should be noted that the NMOS reference voltage is generated with respect to ground. In other words, the voltage VREF22 is +2.2V above the ground potential. Further, the voltage VREF22 is independent of the upper determined I/O buffer power supply potential VDDIO. As will be recalled, this voltage VREF22 of +2.2V is the desired voltage applied to the gates of the NMOS transistors in the gate oxide protected circuits, which have a gate oxide thickness of 60 angstroms in which the I/O buffer power supply potential VDDIO was approximately +3.3 volts.

Similarly, since the operational amplifier 28 is also connected in a non-inverted configuration, its output voltage $V_{02}$ on its output terminal 14 can be expressed mathematically as follows:

$$V_{02}=A2(V_{err2}) \tag{7}$$

where A2 is gain of amplifier 28 Further, the voltage $V_B$ applied to the inverting input is given by:

$$V_B = \frac{R_6}{R_5 + R_6}(V_{02}) + \frac{R_5}{R_5 + R_6}(V_{01}) \tag{8}$$

From Kirchoff's Voltage Law, it can be determined again that:

$$V1=V_{err2}+V_B \tag{9}$$

If the gain A2 of the operational amplifier 28 is assumed to be very high (typically in excess of 100,000), then it can be seen from equation (7) that $V_{err2}$ will be very small. Thus, equation (9) can be simplified to:

$$V1\approx V_B \tag{10}$$

The input voltage V1 from the voltage divider 20 is given by:

$$V1 = \frac{R_4}{R_3 + R_4}(VDDIO) \tag{11}$$

By substituting equations (11) and (8) into equation (10), we have:

$$\frac{R_4}{R_3 + R_4}(VDDIO) = \frac{R_6}{R_5 + R_6}(V_{02}) + \frac{R_5}{R_5 + R_6}(V_{01}) \tag{12}$$

By substituting VREF11=$V_{02}$ and VREF22=$V_{01}$ to equation (12) and solving for VREF11, there is given:

$$VREF11 = \frac{1 + \frac{R_5}{R_6}}{1 + \frac{R_3}{R_4}}(VDDIO) - VREF22\left(\frac{R_5}{R_6}\right) \tag{13}$$

If we let R3=R4 and R5=R6, then equation (13) can be simplified to:

$$VREF11=VDDIO-VREF22 \tag{14}$$

If the upper predetermined I/O power supply potential VDDIO is set to +3.3V and VREF22=2.2V from equation (6) is substituted into equation (14), we have:

$$VREF11=+3.3V-2.2V=+1.1V \tag{15}$$

As can be seen from equation (14), the PMOS reference voltage VREF11 is generated with respect to the upper predetermined I/O power supply potential VDDIO. In other words, voltage VREF11 is +2.2V below the I/O supply potential VDDIO. As a result, the supply potential VDDIO is capable of being adjusted or set at any voltage level in the range between +2.3 and +4.5 volts without sacrificing gate oxide protection and without any change in the circuit performance. The circuit performance will not change because the gate-to-source voltage $V_{GS}$ across the NMOS transistor devices will be +2.2V (or +2.2V−$V_{TN}$) and the gate-to-source voltage VGS across the PMOS transistor devices will also be +2.2V (or +2.2V−$|V_{TP}|$).

From the foregoing detailed description, it can thus be seen that the present invention provides an improved reference voltage generation circuit used in gate oxide protected circuits for generating an NMOS reference voltage and a PMOS reference voltage which are independent of an I/O buffer power supply potential. The reference voltage generation circuit of the present invention includes a bandgap reference voltage circuit, a first operational amplifier, a voltage divider and a second operational amplifier, all operatively interconnected together.

While there has been illustrated and described what is as present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

We claim:

1. A reference voltage generation circuit used in gate oxide protected circuits for generating an NMOS reference voltage and a PMOS reference voltage, comprising:

a first I/O buffer power supply voltage having an upper voltage level;

a second I/O buffer power supply voltage having a lower reference voltage level;

a bandgap voltage reference circuit for generating a stable reference voltage;

a first operational amplifier having a non-inverting input, an inverting input and an output, said non-inverting input being connected to receive the stable reference voltage, said output being connected to a first output terminal for generating the NMOS reference voltage;

a first resistor having its one end connected to the output of said first operational amplifier and its other end connected to the inverting input of said first operational amplifier;

a second resistor having its one end also connected to the inverting input of said first operational amplifier and its other end connected to the lower reference voltage level;

a voltage divider formed of a third resistor and fourth resistor and having its one end connected to said upper voltage level and its other end connected to the lower voltage level, said voltage divider generating an input voltage proportional to the upper voltage level;

a second operational amplifier having a non-inverting input, an inverting input, and an output, said non-inverting input being connected to receive said input voltage from said voltage divider, said output being connected to a second output terminal for generating the PMOS reference voltage;

a fifth resistor having its one end connected to the output of said second operational amplifier and its other end connected to the inverting input of said second operational amplifier; and a sixth resistor having its one end connected also to the inverting input of said second operational amplifier and its other end connected to receive the NMOS reference voltage at the output terminal of said first operational amplifier.

2. A reference voltage generation circuit as claimed claim 1, wherein said upper voltage level is adjustable in the range between +2.3 volts and +4.5 volts.

3. A reference voltage generation circuit as claimed claim 1, wherein said upper voltage level is approximately +3.3 volts.

4. A voltage reference generation circuit as claimed claim 3, wherein said lower reference voltage is approximately zero volts.

5. A reference voltage generation circuit as claimed claim 4, wherein said stable reference voltage is approximately +1.25 volts.

6. A reference voltage generation circuit as claimed claim 5, wherein said NMOS reference voltage at said output terminal of said first operational amplifier is approximately +2.2 volts and is referenced with respect to said lower reference voltage.

7. A reference voltage generation circuit as claimed claim 6, wherein said PMOS reference voltage at said output terminal of said second operational amplifier is approximately +1.1 volts and is referenced with respect to said upper voltage level and said NMOS reference voltage.

8. A reference voltage generation circuit as claimed claim 7, wherein said third and fourth resistors have the same resistance value.

9. A reference voltage generation circuit as claimed claim 8, wherein said fifth and sixth resistors have the same resistance value.

* * * * *